US010560984B2

(12) United States Patent
Hoffman et al.

(10) Patent No.: US 10,560,984 B2
(45) Date of Patent: Feb. 11, 2020

(54) INDUCTIVE HEATER FOR FLUIDS

(71) Applicant: Hydra Heating Industries, LLC, Atlanta, GA (US)

(72) Inventors: Michael Hoffman, Foley, AL (US); Shuping Wang, Minneapolis, MI (US); Anthony S. Deese, Trenton, NJ (US)

(73) Assignee: HYDRA HEATING INDUSTRIES, LLC, Atlanta, GA (US)

( * ) Notice: Subject to any disclaimer, the term of this patent is extended or adjusted under 35 U.S.C. 154(b) by 367 days.

(21) Appl. No.: 15/495,355

(22) Filed: Apr. 24, 2017

(65) Prior Publication Data

US 2017/0311393 A1 Oct. 26, 2017

Related U.S. Application Data

(60) Provisional application No. 62/331,987, filed on May 5, 2016, provisional application No. 62/326,824, filed on Apr. 24, 2016.

(51) Int. Cl.

| | |
|---|---|
| ***H05B 6/10*** | (2006.01) |
| ***H05B 6/06*** | (2006.01) |
| ***H05B 6/36*** | (2006.01) |
| ***H05B 6/44*** | (2006.01) |

(52) U.S. Cl.

CPC ..... *H05B 6/108* (2013.01); *H05B 6/06* (2013.01); *H05B 6/36* (2013.01); *H05B 6/44* (2013.01)

(58) Field of Classification Search

CPC ... H05B 6/02; H05B 6/04; H05B 6/06; H05B 6/108; H05B 6/36; H05B 6/365; H05B 6/44

USPC ..... 219/628, 629, 630

See application file for complete search history.

(56) References Cited

U.S. PATENT DOCUMENTS

| | | | | |
|---|---|---|---|---|
| 5,006,683 A * | 4/1991 | Rapin | ..... | H05B 6/108 219/630 |
| 2005/0095168 A1* | 5/2005 | Centanni | ..... | A61L 2/07 422/3 |
| 2012/0061382 A1* | 3/2012 | Yang | ..... | H05B 6/108 219/628 |

* cited by examiner

*Primary Examiner* — Hung D Nguyen

(74) *Attorney, Agent, or Firm* — Thomas|Horstemeyer LLP

(57) ABSTRACT

Aspects and embodiments of inductive heating systems are described. In one embodiment, the system includes a manifold assembly with number of manifold pipes that are connected to a manifold plate. An inductive coil is around the manifold assembly. A control circuit is electrically coupled to the inductive coil and to a power supply to inductively heat the manifold pipes of the manifold assembly using the inductive coil.

17 Claims, 4 Drawing Sheets

INDUCTIVE HEATER FOR FLUIDS

CROSS-REFERENCE TO RELATED APPLICATIONS

This application claims the benefit of U.S. Provisional Application No. 62/331,987, filed May 5, 2016, titled "Low Frequency Inductive Heating for Liquids," and U.S. Provisional Application No. 62/326,824, filed Apr. 24, 2016, titled "Inline Inductive Heater," each of which is hereby incorporated herein by reference in its entirety.

BACKGROUND

Waste fluids such as waste oil can include a combination of hydrocarbons, oils, gasses, water, other liquids and solids obtained naturally or as a residue from processing. Because oil and other base materials of waste fluids are so viscous, waste fluids can be diluted with additives that become part of the combination so that it can be processed or transported by pipelines and tank cars. The recovery of valuable portions of waste fluids requires extraction and separation systems to separate the various components of the waste fluid.

BRIEF DESCRIPTION OF THE DRAWINGS

Aspects of the present disclosure can be better understood with reference to the following drawings. It is noted that the elements in the drawings are not necessarily to scale, with emphasis instead being placed upon clearly illustrating the principles of the embodiments. In the drawings, like reference numerals designate like or corresponding, but not necessarily the same, elements throughout the several views.

DETAILED DESCRIPTION

As noted above, waste fluids can include a combination of hydrocarbons, oils, gasses, water, other liquids and solids obtained naturally or as a residue from processing. The present disclosure describes inductive heaters for fluids. The inductive heaters described herein can help processing and transportation of these fluids, and in some cases can help extract valuable or useful materials from these fluids. The device can receive colder fluid at one end and emits hotter fluid at the other.

In some embodiments, the inductive heater uses magnetic induction as the primary source for heating although supplemental heating is contemplated, such as a pre-heater. Some of these pre-heaters can use excess heat from inductive coils to pre-heat fluids such as waste oil before this fluid enters the inductively heated portion.

In some embodiments, the inductive heater includes an inductively heated manifold assembly. Liquid comes in one end and is diverted into smaller pipes of the inductively heated manifold assembly, heated, and recombined at the end of the manifold assembly. Also, an inductively heated serpentine assembly can be used. In some embodiments, the serpentine assembly can include straight inductively heated sections, which can include an inductively heated pipe and/or an inductively heated manifold assembly that is divided into multiple pipes as discussed.

Figure 1:
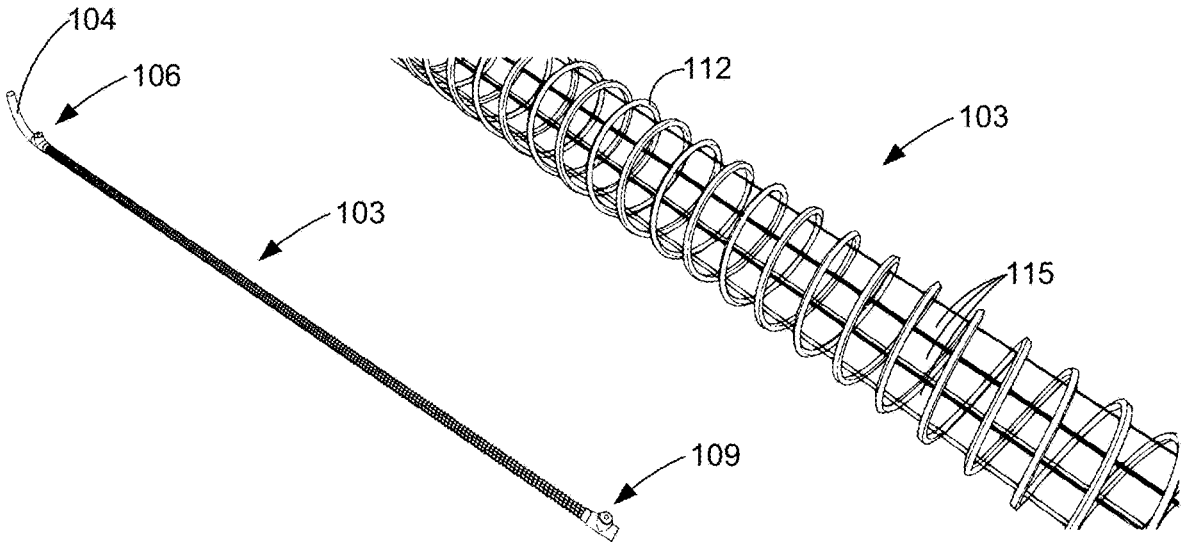
FIG. 1 illustrates a perspective view of an example manifold inductive heater according to one embodiment of the present disclosure.

In some cases, the inductive heaters can use frequency of a power source (e.g., a generator or utility power) as the frequency emitted by the inductive heater. This frequency can be as line frequency or utility frequency (e.g., 50 Hz, 60 Hz, 140 Hz, 400 Hz, etc.). In some embodiments, lower frequencies can penetrate the pipes, vessels or conduits of a heater assembly deeper than higher frequencies. Frequency can be chosen or designed to match the requirements of the application, including power source, and heater assembly Moving now to the figures, FIG. 1 illustrates an inductive heater comprising an inductively heated manifold assembly 103. Injection ports 106 and 109 can be used at the ends of the inductively heated manifold assembly 103. In some cases, an elbow pipe, or another gravity-assisted pipe section can be attached as an entrance pipe 104 of the inductively heated manifold assembly 103. Flowing of fluid through the inductive heater can be gravity-assisted through the use of the elbow or other gravity-assisted pipe section, such as a pipe mounted at an angle that allows for fluid to flow through the entrance pipe 104 and the inductive heater. In other embodiments, the entrance pipe 104 can be a straight section of pipe or any pipe. A pump can also be used to cause the fluid to flow through the entrance pipe 104 and the inductive heater. The injection ports 106 and 109 can allow for injecting, mixing, or diluting the fluid with steam or other types of material injections. In the inductive heater, the fluid can be separated from the entrance pipe 104 into the manifold pipes 115, and can be recombined into an exit pipe (not shown). In some cases, the exit pipe can have a diameter or dimensions similar to the entrance pipe. The entrance pipe 104 can be joined to the manifold pipes 115 through the injection port 106, and can be recombined through the injection port 109. In other cases, a manifold plate can be used additionally or alternatively to separate the entrance pipe 104 into the manifold pipes 115 and to recombine the manifold pipes 115 into the exit pipe. Accordingly, a manifold plate can be designed to attach to the entrance pipe 104 at one side, and also attach to the manifold pipes 115 at another side, and another manifold plate can be designed to attach to the manifold pipes 115 at one side, and to the exit pipe at another side.

FIG. 1 also shows a zoomed-in portion of the inductively heated manifold assembly 103. The inductively heated manifold assembly 103 can include an inductive coil 112, and a number of manifold pipes 115. The number of manifold pipes 115 of the inductively heated manifold assembly 103 can be as few as one and as many is practicality permits. The inductive coil 112 can wrap around the manifold pipes 115 as a whole, and/or a subset of the manifold pipes 115, and/or any individual ones of the manifold pipes 115. In some cases, an insulation layer can surround the inductively heated manifold assembly 103 between the inductively heated manifold assembly 103 and the inductive coil 112. In some cases, an insulation layer can surround each of the manifold pipes 115. This arrangement can increase a surface area of the inductive heater. Since the inductive heating system can heat a pipe through induction, and the heated pipe can in turn heat the fluid within the pipe, the increased surface area can help to increase heating. The inductive coil 112 and its power supply can be designed so that the magnetic fields produced extend a certain distance, or a certain effective heating distance, the effective heating distance being the distance from the inductive coil 112 that metals such as a pipe can be heated by the inductive coil 112. For example, the inductive coil 112 can be designed such that the magnetic fields have an effective heating distance sufficient to heat the manifold pipes 115.

In some cases, the effective heating distance of the inductive coil 112 can be designed to be a predetermined percentage of the diameter of the inductive coil 112, for example, approximately 5% of the diameter of the inductive coil 112, or approximately 50% of the diameter of the inductive coil 112. The effective heating distance of the inductive coil 112 can be designed to be other percentages of the diameter of one of the manifold pipes 115, from 0% to 200% are contemplated. In other cases, the effective heating distance of the inductive coil 112 can be designed to be a predetermined percentage of a diameter of one of the manifold pipes 115, for example, inductive coil 112, for example, approximately 50% of the diameter of one of the manifold pipes 115, or approximately 100% of the diameter of one of the manifold pipes 115. The effective heating distance of the inductive coil 112 can be designed to be other percentages of the diameter of one of the manifold pipes 115, and any percentage can be contemplated, depending on the particular diameter of the manifold pipes 115. As discussed earlier, lower frequencies can penetrate the pipes, vessels or conduits of a heater assembly deeper than higher frequencies. Frequency can be chosen or designed to match the requirements of the application, including power source, and heater assembly arrangement.

Each of the manifold pipes 115 can be smaller than the entrance pipe 104. The inductively heated manifold assembly 103 can include any number of manifold pipes 115. In some embodiments, the manifold pipes 115 can be arranged such that they fit within a circle having a diameter similar to an external diameter of the entrance pipe 104, or a circle having a diameter that is the same as the external diameter of the entrance pipe 104. Where the entrance pipe 104 is inductively heated using an inductive coil of a certain diameter, it can be beneficial for the inductive coil 112 around the manifold pipes 115 as a whole to use a similar diameter. This can aid simplicity of design and compatibility of parts.

In some cases, each of the manifold pipes 115 can be the same size, such that one of the manifold pipes 115 has a same diameter as another one of the manifold pipes 115. In some cases, the manifold pipes 115 can be arranged or designed such that multiple different diameters are used. Further, the manifold pipes 115 can be arranged within a circular cross-sectional area that is approximately an inside diameter of the inductive coil 112 using a circle packing or a circle packing technique that can be used to specify that each of the manifold pipes 115 touch one another, or such that each of the manifold pipes 115 are within a certain maximum distance from one another, or within a certain minimum distance from one another, while a subset of the manifold pipes 115 (e.g., those towards the outside of the bundle) maintain a certain minimum (or maximum) distance from the inductive coil 112 that is around the manifold pipes 115. The inductive coil 112 can be a helical coil. The coil configuration in can be calculated to match a generator or power source and can be designed so that the desired heat rise or delta is achieved in the inductive heater as a whole, and/or in the inductively heated manifold assembly. If more heat is required the length of the inductively heated manifold assembly 103 can be extended straight, serpentine, or in other configurations as is suitable to the space allocated to provide the desired heating.

In some cases, the manifold pipes 115 can be designed so that a sum of the internal cross-sectional areas of the manifold pipes 115 is similar to (e.g., up to 25% greater or lesser) a cross-sectional area of the entrance pipe 104. In some cases, the manifold pipes can fit within a circle of a diameter greater than the external diameter of the entrance pipe 104. Also, since the pipes themselves take up a certain amount of area, the sum of the internal cross-sectional areas of the manifold pipes 115 can be less than the entrance pipe 104 where the manifold pipes 115 fit within a circle having a diameter similar to the external diameter of the entrance pipe 104. In some cases the inductively heated manifold assembly 103 and the inductive coil 112 can be encased in an enclosure or housing (not shown). The housing can include air, water, argon or another inert gas, or another heat exchange fluid, and can be in fluid connection with a pre-heater in a heat exchanging system to exchange heat and pre-heat the entrance pipe 104 and thereby pre-heat the waste oil or other fluid to be heated.

Figure 2:
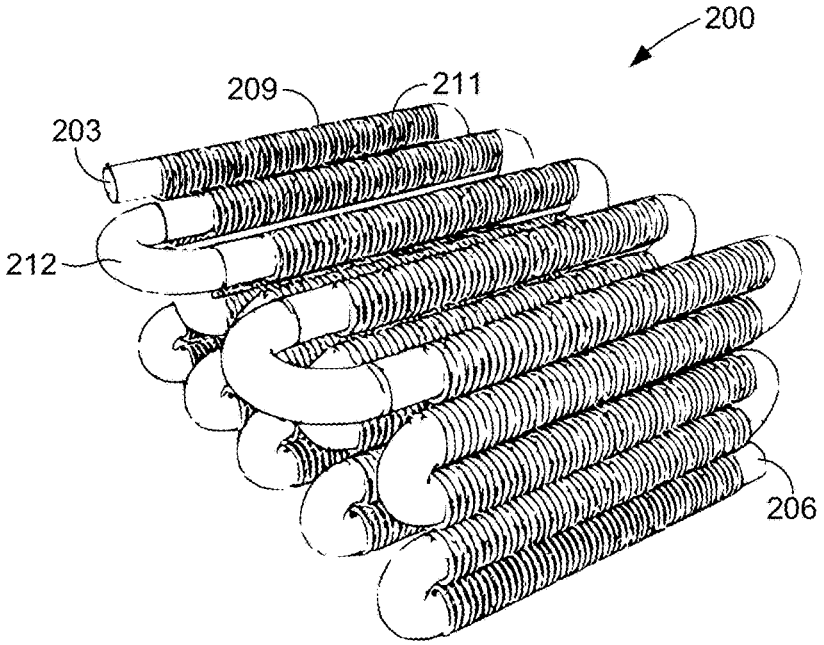
FIG. 2 illustrates a perspective view of another example serpentine inductive heater according to one embodiment of the present disclosure.

FIG. 2 shows an inductively heated serpentine assembly 200 of an inductive heater. The inductively heated serpentine assembly 200 can include an entrance 203, an exit 206, a number of straight sections 209, and u-pipe or elbow pipe sections 212. While not shown, the entrance 203 and/or the exit 206 can include an injection port like the injection ports 106 and 109. The elbow sections can be attached to the straight sections 209 to make a serpentine shape of the inductively heated serpentine assembly 200. The straight sections 209 can be pipe sections, or can be inductively heated manifold assemblies like the inductively heated manifold assembly 103.

In some examples, the inductively heated serpentine assembly 200 can include an inductive coil around each of the straight sections 209 with inductive coils 211. The elbow sections 212, for assembly purposes and/or service access, may not be surrounded by an inductive coil as shown. However, in some cases, one or more of the elbow sections 212 can be surrounded by an inductive coil.

In some cases, the entrance 203 can be higher than the exit 206 so that gravity can assist the aggregate flow of fluid in the fluid system of the inductively heated serpentine assembly 200, as shown. In some cases, the inductively heated serpentine assembly 200 can be designed to have a downhill design or drain slope. To this end, each straight section 209 of the inductively heated serpentine assembly 200 can maintain a drain slope. Each successive straight section 209 can be lower than the previous section such that the drain slope is maintained such that the inductively heated serpentine assembly 200 has a downhill flow and the fluid being heated does not have to flow uphill within the serpentine assembly 200. For example, the serpentine assembly 200 can have a top row of straight sections 209, and a lower row of straight sections. The fluid can flow through each of the a top row of straight sections 209 before moving or flowing to the next, lower row of straight sections, and so on to the exit 206. In some examples, the inductively heated serpentine assembly 200 can further be driven by a pump. In some cases, the pump can provide sufficient pressure such that slope considerations are unnecessary.

In some cases the inductively heated serpentine assembly 200 can be encased in an enclosure or housing (not shown). This enclosure can utilize excess heat from the system, such as heat that is generated outside of the pipes containing waste oil or other fluid to be heated. The excess heat can be utilized in a heat exchanging system. The heat exchange system can include a pre heater for the waste oil or other fluid being heated, as will be discussed. The enclosure or housing can include air, water, or another heat exchange fluid, and can be in fluid connection with a pre-heater in a heat exchanging system to exchange heat and pre-heat, for example, an entrance pipe and thereby pre-heat the waste oil or other fluid to be heated.

Figure 3A:
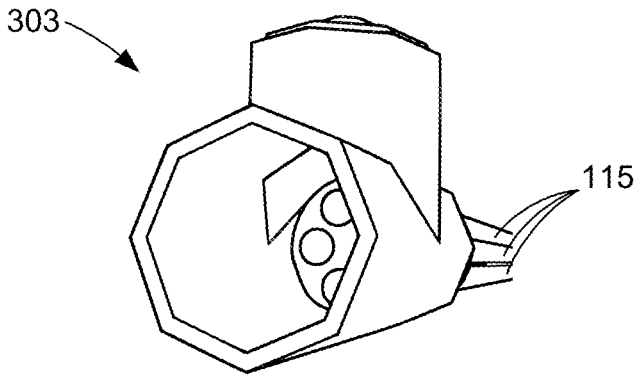
FIGS. 3A-3C illustrate a perspective views components of the manifold inductive heater of FIG. 1 according to one embodiment of the present disclosure.

FIG. 3A shows an injection port 303. The injection port 303 is much like the injection ports 106 and 109 shown in FIG. 1. The injection port 303 can allow for injecting, mixing, or diluting the fluid with steam, hot gasses, hot oil or other types of material injections. Fluid can be separated from an entrance pipe into the manifold pipes 115 through the injection port 303. Accordingly, the injection port 303 can be designed to attach around the entrance pipe at one side, and also attach to the manifold pipes 115 at another side. Another injection port, such as the injection port 109 of FIG. 1, can be designed to attach to the manifold pipes 115 at one side, and to an exit pipe at another side.

Figure 3B:
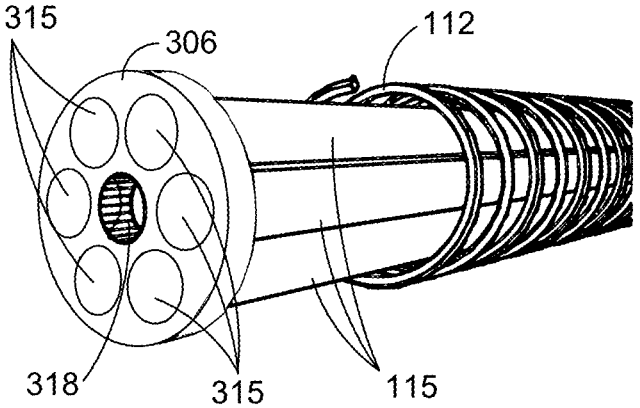

FIG. 3B shows a manifold plate 306 connected to manifold pipes 115. The manifold plate 306 can include manifold pipe connectors 315 and 318, that connect the manifold pipes 115 to the manifold plate 306. In some cases, the manifold plate can be part of an injector port, and in other cases it can be part of another fitting or can be used on its own. The manifold plate 306 can be screwed, welded, glued, epoxied, or otherwise connected to the manifold pipes 115, an entrance pipe and/or an exit pipe.

In some cases, there can be a center manifold pipe (corresponding to the manifold pipe connector 318), and the rest of the manifold pipes can be arranged, for example in a circular pattern, around the center manifold pipe as shown (i.e., outer manifold pipes). The outer manifold pipes can each have the same diameter or approximately the same diameter. The center manifold pipe can have a same diameter as the outer manifold pipes, a larger diameter than the outer manifold pipes, or a smaller diameter than the outer manifold pipes in the various embodiments. In other cases, the manifold pipes 115 can be arranged in a circular pattern around a center area occupied by a magnetic flux shield material or a high permeability material to affect the magnetic field of the inductive heater and increase heating of the manifold pipes. For example, a center hollow pipe or solid pipe that comprises magnetic flux shield material or a high permeability material. The center manifold pipe can also be injected with hot oil, gas, or other fluid.

In order to increase inductive coupling, in some cases, the center manifold pipe can be wrapped or surrounded by another inductive coil around the center manifold pipe. The other inductive coil around the center manifold pipe can heat the center manifold pipe as well as help to heat the outer manifold pipes arranged around it.

Figure 3C:
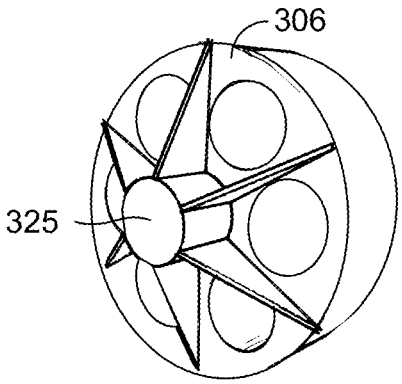

FIG. 3C shows a finned disbursement device 325 on a manifold plate 306. The finned disbursement device 325 can be used on any manifold plate 306, including a manifold plate 306 connected to an entrance pipe. In some cases, the finned disbursement device 325 can be separate from the manifold plate 306, and can be installed within or attached to an entrance pipe. The finned disbursement device 325 can help to distribute the fluid more evenly from an entrance pipe into the manifold pipes 115. The blades or other fins of the finned disbursement device 325 cause relatively even distribution of the fluid, directing it into each of the manifold pipes 115. The fins of the finned disbursement device 325 can extend from the center of the finned disbursement device 325, and can have a uniform thickness, or taper down from the center of the finned disbursement device towards the ends of the fins as shown (e.g., towards the pipe wall/outer edge of the manifold plate). In other cases, the fins can expand out from the center of the finned disbursement device 325 so they are thicker towards the ends of the fins (e.g., towards the pipe wall/outer edge of the manifold plate). In some cases the fins can be set on the center of the finned disbursement device 125 so they are orthogonal with respect to the manifold plate 306, and in other cases the fins can be angled with respect to the manifold plate 306. While not shown, the finned disbursement device 325 can comprise fins or blades mounted at an angle with respect to the length of the entrance pipe 104, or otherwise designed to cause a rotation of the fluid or a vortex of the fluid within the entrance pipe before it enters the manifold pipes 115. The center of the finned disbursement device 325 can be solid, or a hole may be inserted, such that a center pipe of the manifold pipes 115 can be accommodated, and/or injection can occur. A finned disbursement device 125 can also be included on the manifold plate 306 where the fluids are recombined at the exit pipe.

Figure 4:
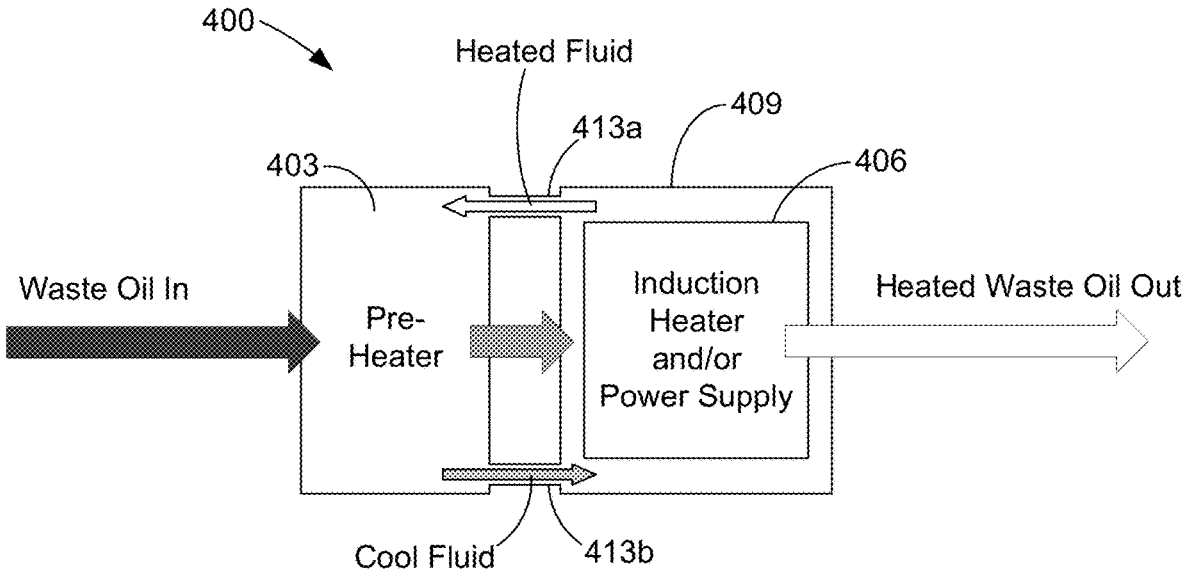
FIG. 4 is a diagram that illustrates an example of the operation of an inductive heater according to one embodiment of the present disclosure.

In FIG. 4, a schematic illustrates the components of the induction heating system which includes a preheater 403 and induction heater 406. The preheater 403 utilizes the waste heat from the induction coil, such as the inductive coil 112 of FIG. 1 and/or the inductive coil 211 of FIG. 2, to preheat the incoming waste oil to enhance the overall system efficiency while keeping the working coil temperature low. In one example, an exchange fluid such as water, air, argon, can be within a housing 409 around the induction coils and the housing 409 can be in fluid connection 413*a* and 413*b* with a preheater 403 that can heat the incoming fluid to be heated (e.g., waste oil) before it reaches the inductively heated section (e.g., while in an entrance pipe). An overall system efficiency of about 90% can be achieved in such configuration. Overall efficiency may change in different embodiments. For example, if the coils are solid instead of water cooled, or if the power system is not water cooled, the preheating arrangement may not be feasible. In such cases, the other embodiments of the invention perform at a lesser system efficiency. A similar system can use the waste heat from a power supply to heat the exchange fluid and cool a component of the power supply.

Induction Heater Design:

The induction coils can include several runs or sections of inductively heated pipes and or manifold assemblies, an inlet waste oil header, an outlet waster oil header, and multiple coiling cooling flow headers. The heat can be generated within the pipe wall. A coil can be made of the flat copper coil or copper tubing. Where a pre-heater 403 is used, water or other fluid can be included in an enclosure about the induction heater 406, and an internal flow of the heated fluid can be provided from the induction heater 406 into a the pre-heater 403 and cool fluid can re-enter the enclosure of the induction heater 406. For inductively heated sections, any magnetically or electrically conductive materials such as carbon steel, aluminum, and stainless steel could be considered, including pipes, tanks, and manifold assemblies of pipes. The heat transfer can be simplified as constant heat flux on the interface of the wall of the pipes to the fluid to be heated. The maximum heat flux could be applied to the waste oil is limited by the convective heat transfer rate inside the pipes. The various embodiments include vessels and pipes or other containers made of. In one embodiment an upright tank's liquid can be heated with inductive coils that surround the tank, or pancake coils that are mounted with the coil flat to the side of the tank.

In some examples, the fluid can include waste oil described as follows:

Fluid: waste oil (approximately 50% water, 50% oil)

Inlet temperature $T_i$: 50 F (12° C.)

Outlet target temperature $T_o$: 180 F (82° C.)

Fluid properties at mean temperature $T_m=(T_i+T_o)/2=47°$ C. The thermo-physical properties of the waste oil is weighted according to its composition.

Density $\rho=(873+989)/2=931$ kg/m$^3$

Specific heat $c_p=(1.76+4.06)/2=2.91$ kJ/kg/K

Dynamic viscosity $v=(6e^{-7}+3e^{-6})/2=1.5e^{-6}$

Thermal conductivity $k=(0.6+0.12)/2=0.36$ W/m/K

Prandtl number $P_r=1.5e^{-6}/(0.36/2910/931)=11$

In one example, the flow rate can be 50 GPM (0.0032 m$^3$/s). The desired temperature rise can be 130° F.

Total heating power required $$Q_h=\rho G c_p(T_o-T_i)=0.6 \text{ MW}$$

Total power source power, assuming 60% overall electrical to heat efficiency $\eta_t$ without heat recovery:

$$Q_p=\frac{Q_h}{\eta_t}=1.2 \text{ MW}$$

Total power source power, assuming 60% overall electrical to heat efficiency $\eta_t$ with heat recovery of recovery efficiency $\eta_r$ of 80%:

$$Q_p=\frac{Q_h}{\eta_t+(1-\eta_t)n_r}=0.65 \text{ MW}$$

System Configuration:

For initial sizing in this embodiment, we consider a pipe diameter D of 2 inches. In the example of a serpentine or any other arrangement of pipe sections of length (L) of inductively heated pipes, a combination of diameter (D), and section length (L), and number of sections can be determined. In the example of a serpentine arrangement, a number of sections (S) can be M×N, where N is a number of rows and M is number of columns. As an example, we can set N=4 and M=5.

The flow rate in each serpentine pipe can be G/N. The Reynolds number can be 13367 in the fully developed turbulent region.

$$Re_D=\frac{\bar{u}D}{v}=\frac{4G}{\pi NDv}=13367$$

The Nusselt number can be $$Nu_D=0.023Re_D^{4/5}Pr^{0.4}=119$$

The convective heat transfer coefficient can be $$h_{conv}=\frac{kNu_D}{D}=856.8\frac{W}{m^2K}$$

The minimum temperature difference between the fluid and the pipe wall would occur at the outlet, where the fluid temperature equals to the target temperature of 82° C. Assuming the boiling point of the waste oil is 176° C. (350 F), which is the limiting wall temperature, then the minimum heat flux would be $$q_{min}=h_{conv}(176-82)=77112 \text{ W/m}^2$$

At the inlet, the allowable or maximum heat flux can be greater $$q_{max}=h_{conv}(176-12)=137088 \text{ W/m}^2$$

For the actual system, each group of the coils can be controlled independently to achieve maximum performance. For the initial sizing, we can consider constant heat flux throughout the full pipe length of $q_m=q_{max}+q_{min})/2=107.1$ kW/m$^2$.

The heat delivered to the induction heater can be $$Q_{induction}=Q_p\times\eta_t=0.39 \text{ MW}$$

Which can also be calculated as $$Q_{induction}=\pi DLMNq_m$$

Therefore, in this example, for M=5, L=1.14 m. The total footprint of this embodiment of the induction heater itself would be less than 2 by 2 by 2 m (or less than 6 ft by 6 ft by 6 ft).

The pressure drop through the heater, the induction coil assembly efficiency (e.g. number of turns) are not considered in this preliminary heat transfer analysis. A full design optimization can consider a balance between the cost and effectiveness of all three aspects of the system including heat transfer, pumping, and electrical.

Figure 5:
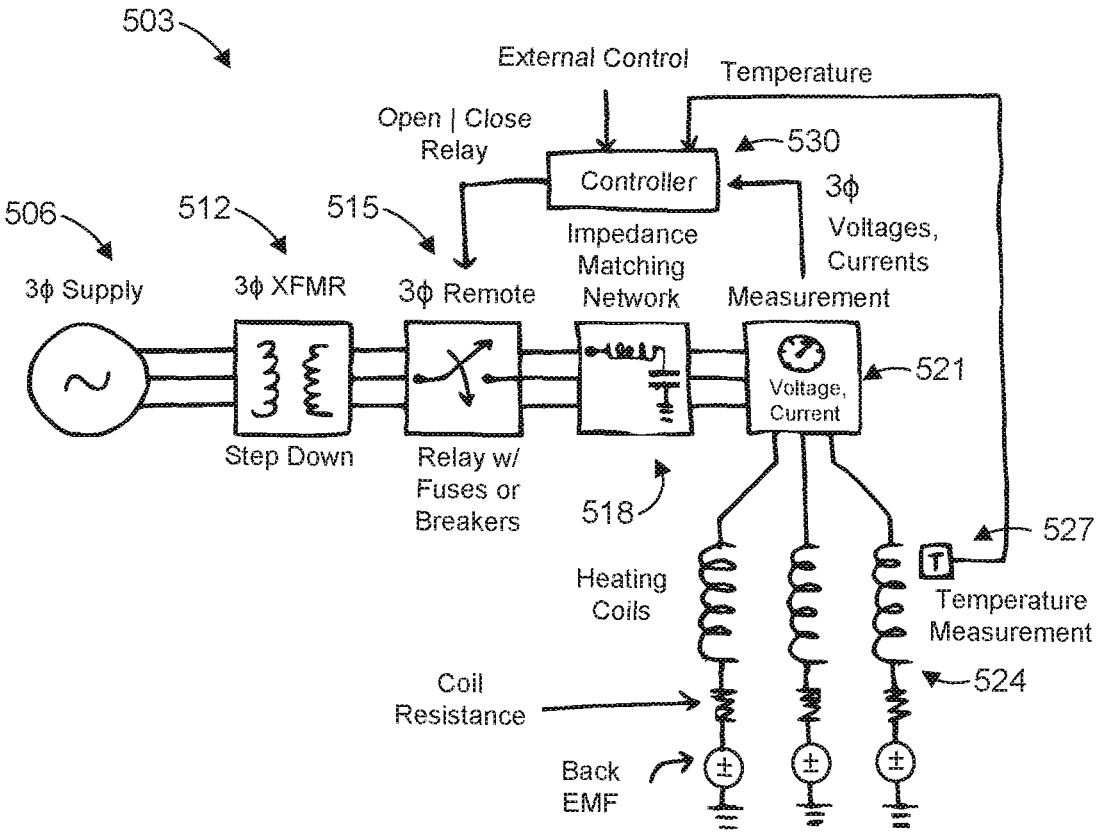
FIG. 5 is a diagram that illustrates an example control circuit of an inductive heater according to one embodiment of the present disclosure.

FIG. 5 shows an example control circuit 503. The control circuit 503 can include a transformer 512, relay with fuses or breakers 515, impedance matching network 518, meters 521 that can measure the voltage and current, one or more thermocouples 527 (e.g., for each inductive coil), and a controller 530. The control circuit 503 can be connected to a power supply 506 and heating coils 524, which can include inductive coils like the inductive coils 112 of FIG. 1 and inductive coils 211 of FIG. 2. Thermocouples 530 and the meters 521 can communicate with the controller 530, and the controller 530 can gate, limit, or control the heating temperature and the power delivered based on the meters 521 and the thermocouples 530. In one example, the controller 530 can open or close relays or switches, and can control or adjust other circuit components of the control circuit 503 like variable resistances, reactances, capacitances, inductances, and the like. The control circuit 503 can measure a temperature of the inductive coils (e.g., using the thermocouples or another measuring device) and control the inductive coils to maintain the temperature below a predefined threshold temperature. The control circuit 503 can measure the temperature of each of the inductive coils in the system independently, and can adjust power or other circuit components in order to individually control each of the inductive coils in the system. The control circuit 503 can control each inductive coil to maintain a same predefined threshold temperature, or control each inductive coil to maintain its own individual predefined threshold temperature, such that one inductive coil is set to have a higher threshold temperature than another inductive coil in the system.

The power source can be utility power. However, other energy sources in other embodiments may be used (e.g., an electrical generator or fuel cell). When practical the natural frequency of the line can be utilized, although it may be factored or multiplied in some embodiments. For example, line frequency of 60 hertz may be factored to 120 hertz or 240 hertz as the engineering finds expedient. While low frequencies (e.g., utility frequencies like 50 Hz, 60 Hz, 140 Hz, 400 Hz are contemplated for most embodiments, higher frequencies may be utilized as desired for the application.

The transformer 512 may not be necessary in some embodiments if the line power is clean and appropriate for direct use. The relays and breakers or fuses 515 can allow for soft switching by initial use of lower current and/or voltage and once the connection is made, increasing current and/or voltage.

The impedance matching network 518 can provide for good energy transfer, and can be adjusted by the controller 530 in view of the inductive coils 524. In some embodiments like in line fluid heating as in FIG. 1 and FIG. 2, the coils are wrapped around the pipe or pipe assembly. In other embodiments, the coils are wrapped around larger tanks or vessels, or the coil can be a "pancake coil" that is coiled flat to the surface of a tank or other surface.

In some embodiments, but not all embodiments, insulation can be used to regulate temperature and heat escaping the pipes. In some embodiments, heating waste oil inline, the heat generated by the coils and power supply can be captured by the heat exchange fluid that is inside the enclosure that can surround the coils, as well as the power unit. The heat exchange fluid can be water or other liquids, air or other gasses, or another fluid. The heat exchange fluid can be routed through pre-heater in a heat exchange arrangement to capture the heat and preheat the waste oil or other fluids before they enter the inductively heated sections. Tank embodiments can use pancake coils radially mounted to the sides or helical surrounding coils.

As used herein, the term "approximate," or "approximately" can refer to a distance or measure that differs by about 30% or less, about 25% or less, about 20% or less, about 15% or less, about 10% or less, or about 5% or less than the indicated distance or measure. The term "or less" can indicate a range that extends to 0% or to 0.01%. As used herein, the term "similar to," for example in the phrase "diameter similar to," can refer to diameter that differs by about 30% or less, about 25% or less, about 20% or less, about 15% or less, about 10% or less, or about 5% or less. The term "or less" can indicate a range that extends to 0% or to 0.01%.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

Therefore, at least the following is claimed:

1. An inductive heating system, comprising:
an entrance pipe;
a plurality of manifold pipes;
a manifold plate, the manifold plate being attached to the entrance pipe and the plurality of manifold pipes;
an inductive coil around the plurality of manifold pipes;
a control circuit, the control circuit being electrically coupled to the inductive coil and to a power supply to inductively heat the plurality of manifold pipes using the inductive coil, wherein the control circuit measures a temperature using a thermocouple and controls the inductive coil to maintain the temperature below a predefined threshold temperature;
a housing that surrounds at least a portion of the inductive coil, wherein the housing is filled with a heat exchange fluid; and
a pre-heater that is in fluid connection with the housing, wherein the pre-heater exchanges heat with the inductive coil and uses the heat to pre-heat the entrance pipe.

2. The inductive heating system of claim 1, further comprising a finned disbursement device that distributes fluid from the entrance pipe to the plurality of manifold pipes.

3. The inductive heating system of claim 1, wherein the plurality of manifold pipes are arranged within an inside diameter of the inductive coil using a circle packing technique.

4. The inductive heating system of claim 1, wherein a subset of the plurality of manifold pipes are arranged in a circular pattern around a center manifold pipe of the plurality of manifold pipes.

5. The inductive heating system of claim 1, further comprising:
an exit pipe; and
another manifold plate, the other manifold plate being attached to the exit pipe and the plurality of manifold pipes.

6. The inductive heating system of claim 5, wherein the plurality of manifold pipes, the inductive coil, the manifold plate, and the other manifold plate compose a manifold assembly, and at least one additional manifold assembly is attached to the manifold assembly using at least one elbow pipe section, wherein the at least one elbow pipe section, the manifold assembly and the at least one additional manifold assembly compose a serpentine assembly.

7. An inductive heating system, comprising:
a plurality of manifold pipes;
a manifold plate, the manifold plate being attached to the plurality of manifold pipes;
an inductive coil around the plurality of manifold pipes;
a control circuit electrically coupled to the inductive coil and to a power supply to inductively heat the plurality of manifold pipes using the inductive coil;
a housing that surrounds at least a portion of the inductive coil, wherein the housing is filled with a heat exchange fluid; and
a pre-heater that is in fluid connection with the housing, wherein the pre-heater exchanges heat with the inductive coil and uses the heat to pre-heat fluid before it enters the plurality of manifold pipes.

8. The inductive heating system of claim 7, further comprising a finned disbursement device that distributes fluid into to the plurality of manifold pipes from an entrance pipe.

9. The inductive heating system of claim 7, wherein the plurality of manifold pipes are arranged in a circular pattern.

10. The inductive heating system of claim 7, wherein the plurality of manifold pipes are arranged in a circular pattern around a center area comprising a high permeability material.

11. The inductive heating system of claim 7, further comprising another manifold plate, the other manifold plate being attached to the plurality of manifold pipes.

12. The inductive heating system of claim 11, wherein the plurality of manifold pipes, the inductive coil, the manifold plate, and the other manifold plate compose a manifold assembly, and at least one additional manifold assembly is attached to the manifold assembly using at least one elbow pipe section, wherein the at least one elbow pipe section, the manifold assembly and the at least one additional manifold assembly compose a serpentine assembly.

13. An inductive heating system, comprising:

an inductively heated serpentine assembly comprising a plurality of straight sections, each straight section comprising at least one pipe, and an elbow pipe section that joins a first straight section of the plurality of straight sections and a second straight section of the plurality of straight sections;

a first inductive coil around the first straight section of the plurality of straight sections;

a second inductive coil around the second straight section of the plurality of straight sections;

a control circuit, the control circuit being electrically coupled to the first inductive coil and the second inductive coil and to a power supply to inductively heat the inductively heated serpentine assembly using a plurality of inductive coils comprising the first inductive coil and the second inductive coil;

a housing that surrounds at least a portion of the first inductive coil and at least a portion of the second inductive coil, wherein the housing is filled with a heat exchange fluid; and a pre-heater that is in fluid connection with the housing, wherein the pre-heater exchanges heat with the inductive coil and uses the heat to pre-heat fluid before it enters the inductively heated serpentine assembly.

14. The inductive heating system of claim 13, wherein the first straight section comprises a plurality of manifold pipes and a manifold plate, the manifold plate being attached to the plurality of manifold pipes.

15. The inductive heating system of claim 14, wherein the first straight section further comprises a finned disbursement device that distributes fluid from an entrance pipe to the plurality of manifold pipes through the manifold plate.

16. The inductive heating system of claim 13, further comprising a pump that pumps fluid through the inductively heated serpentine assembly.

17. The inductive heating system of claim 13, wherein a first subset of the plurality of straight sections is arranged in a first row, and a second subset of the plurality of straight sections is arranged in a second row, wherein fluid flows through the first row and then the second row, and wherein the second row is lower than the first row.

* * * * *